United States Patent [19]

Roper et al.

[11] Patent Number: 4,506,623

[45] Date of Patent: Mar. 26, 1985

[54] NON-RIGID BUOYANT MARINE STORAGE VESSELS FOR FLUIDS

[75] Inventors: Brett E. Roper, The Woodlands; Juan M. Herrera, El Paso, both of Tex.

[73] Assignee: Oilfield Industrial Lines, Inc., Big Spring, Tex.

[21] Appl. No.: 469,981

[22] Filed: Feb. 25, 1983

[51] Int. Cl.[3] ..... B65D 89/10

[52] U.S. Cl. ..... 114/256; 114/321; 114/54; 114/267; 405/210; 16/356

[58] Field of Search ..... 114/256, 257, 54, 74 T, 114/264, 266, 267, 321; 405/210; 16/356, 355, 363, 374, DIG. 29

[56] References Cited

U.S. PATENT DOCUMENTS

| | | | |
|---|---|---|---|
| 1,337,250 | 4/1920 | Meguerditchian | 114/54 |
| 2,487,786 | 11/1949 | Bogle | 114/74 T |
| 2,924,191 | 2/1960 | Blumquist et al. | 114/266 |
| 3,056,373 | 10/1962 | Hawthorne et al. | 114/74 T |
| 3,359,594 | 12/1967 | Pastoor | 16/356 |
| 3,837,310 | 9/1974 | Toyama | 405/210 |
| 3,908,577 | 9/1975 | Struyk | 114/352 |
| 3,943,724 | 3/1976 | Banzoli et al. | 405/210 |
| 4,232,983 | 11/1980 | Cook et al. | 405/210 |

*Primary Examiner*—Trygve M. Blix
*Assistant Examiner*—Thomas J. Brahan
*Attorney, Agent, or Firm*—Brady, O'Boyle & Gates

[57] ABSTRACT

A buoyant marine storage vessel for fluids, such as oil, includes a flexible containment bag having at least a controllable inlet and outlet for fluids and a wire rope cage for the bag which is attached to the bag in such a manner that emptying of the fluid content of the bag is enabled by the buoyant pressure of water in which the vessel is located. The vessel can be anchored at a desired location and may include a buoyant support and protective frame having sections articulated on two perpendicular axes. Clusters of vessels may be created for storing large volumes of fluid with economy.

15 Claims, 12 Drawing Figures

FIG. 1
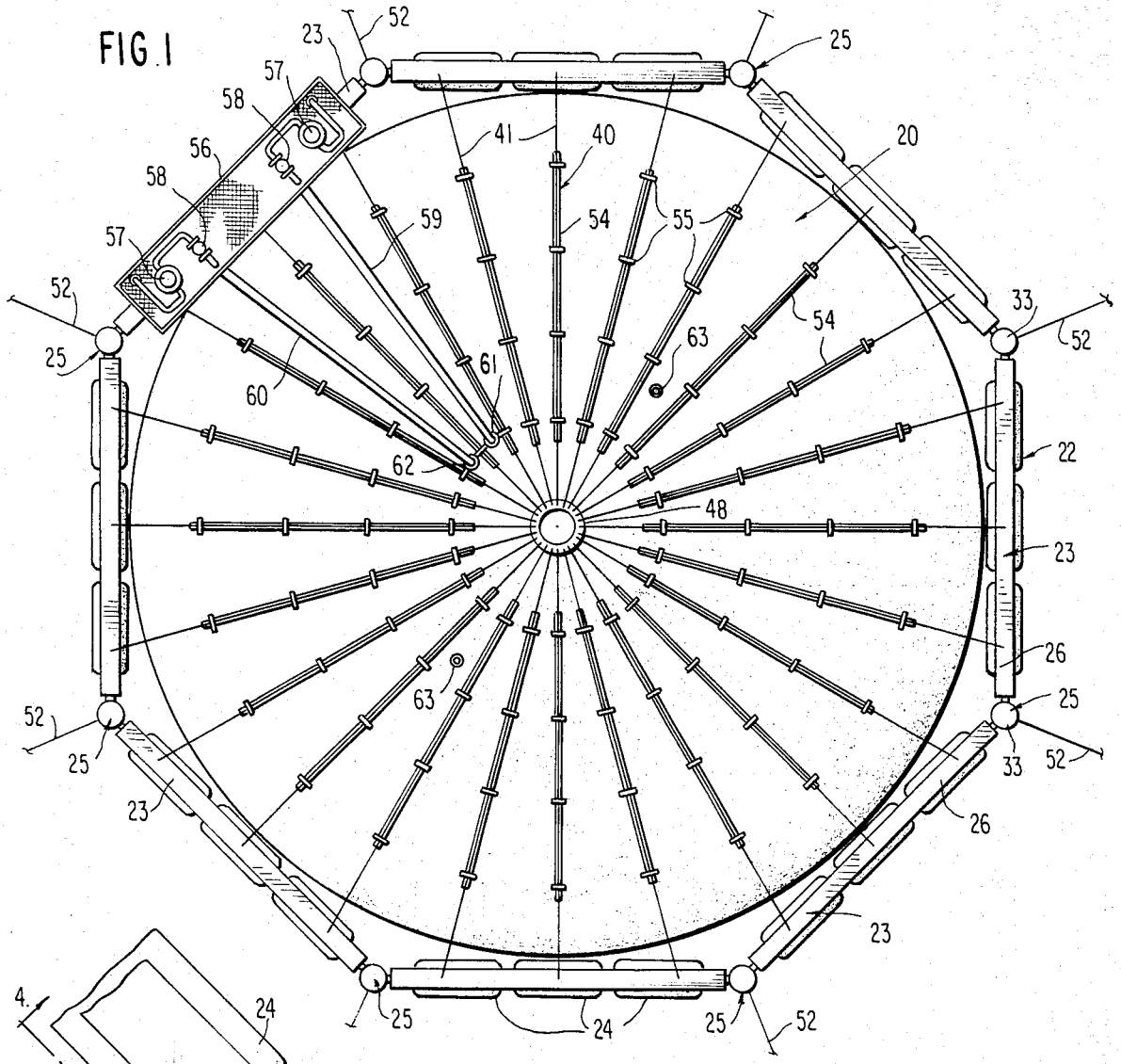
FIG. 3
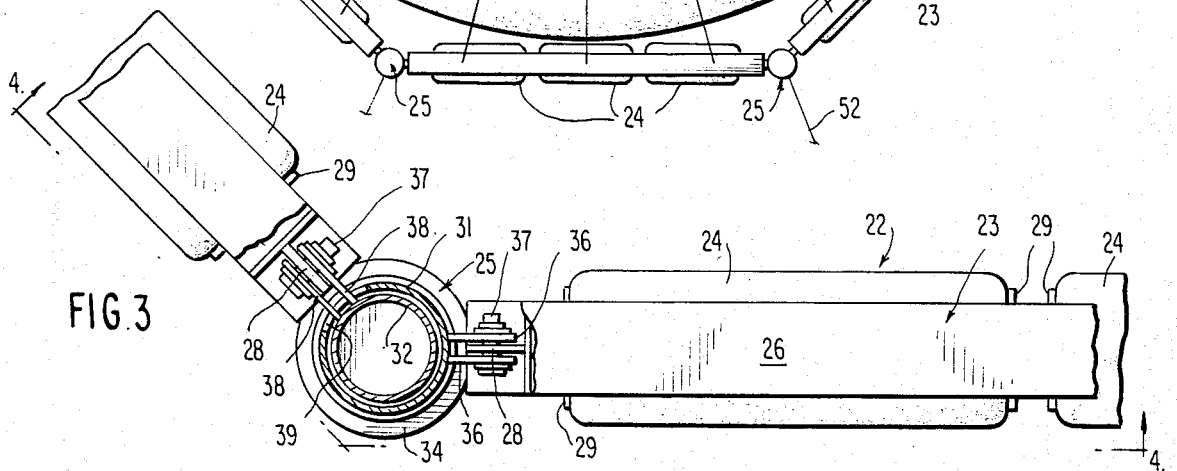
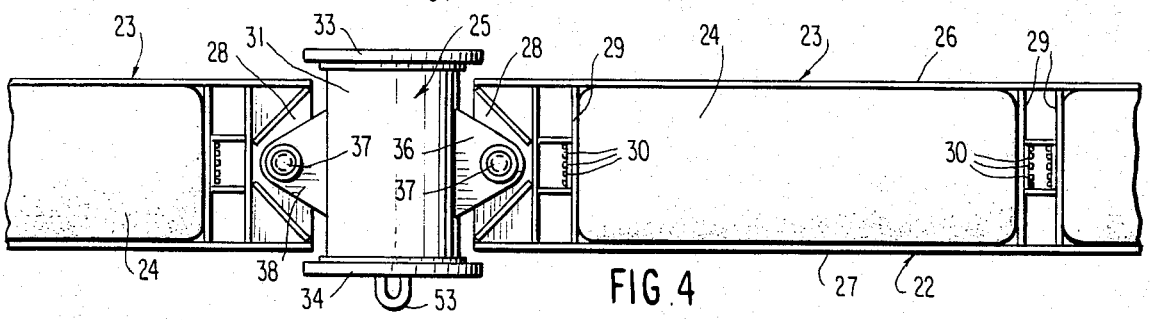
FIG. 4

NON-RIGID BUOYANT MARINE STORAGE VESSELS FOR FLUIDS

BACKGROUND OF THE INVENTION

The present invention seeks to satisfy a need for a more cost effective, simpler and generally more efficient marine bulk storage facility for oil or other fluids.

For example, many offshore oil wells of relatively low production do not justify the construction of expensive rigs and pipe lines for transferring oil from the well to a land-based storage facility. In the case of wells with higher production of oil, various offshore-land transfer and storage depots are in existence or have been proposed. Such facilities are of a more or less permanent nature and include very costly structural components requiring, in many cases, years to build and/or dismantle.

In contrast to the prior art, the present invention can provide a marine storage facility of easily variable capacity to satisfy almost any need. The facility can be constructed in a given location in a matter of weeks or months, instead of years. Single fluid storage vessels, or clusters of vessels, with capacities of hundreds of millions of barrels are readily feasible by means of the invention. Furthermore, a storage facility constructed in accordance with the invention is much more adaptable to widely varying marine environments, storms and the like.

An object of the invention is to provide a marine storage vessel or cell for bulk fluids having a flexible containment bag body portion, resistant to impact and tearing as well as abrasion, and generally very tough and durable, with the ability at all times to yield in response to marine pressures exerted thereon.

Another object is to provide a marine storage vessel which will resist corrosives and chemicals and marine organisms as well as hydrogen embrittlement.

Another important object of the invention is to provide a buoyant flexible vessel having a wire rope cage constructed and arranged so that it does not impede upward collapsing of the vessel responsive to water pressure in the emptying process.

Another object is to provide a storage vessel or cell of the type mentioned which is constructed throughout to avoid dissimilar materials, such as metal and synthetic fabric, from rubbing against each other and thus causing abrasion or wear.

Other features and advantages of the invention will be apparent to those skilled in the art during the course of the following description.

BRIEF DESCRIPTION OF THE DRAWINGS

FIG. 1 is a plan view of a marine storage vessel for fluids according to the invention.

FIG. 3 is an enlarged fragmentary plan view, partly in section, of an articulated flotation and support frame for the storage vessel.

FIG. 4 is a fragmentary side elevational view of the frame taken on line 4—4 of FIG. 3.

DETAILED DESCRIPTION

Figure 9:
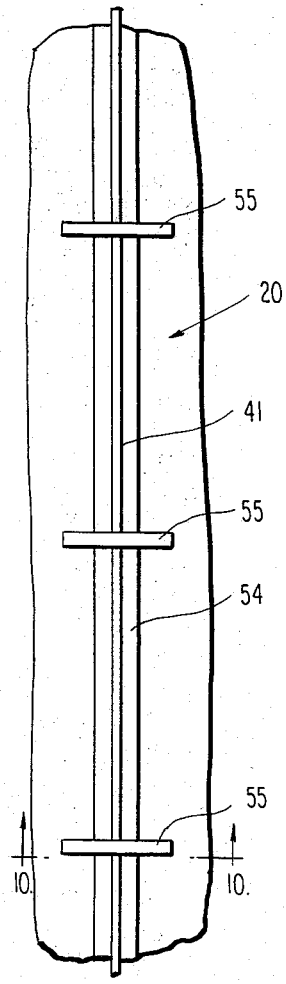
FIG. 9 is an enlarged fragmentary plan view of the vessel showing confining means for one wire rope.
Figure 10:
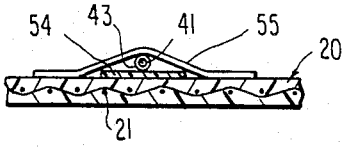
FIG. 10 is an enlarged fragmentary section taken on line 10—10 of FIG. 9.

Referring to the drawings in detail wherein like numerals designate like parts, attention being directed first to FIGS. 1 through 10 showing one preferred embodiment, the numeral 20 designates a circular containment bag or envelope for the bulk storage of oil or the like which is formed from state-of-the-art flexible synthetic sheet material of a tough and durable tear, abrasion and corrosion resistant type. Known synthetic materials, either coated or uncoated, may be employed to make the flexible bag 20 and, as shown in FIG. 10, the sheet material may have an internal fabric reinforcement 21. In some cases, the containment bag 20 may be of unit construction to form a single storage cell. In other cases, depending somewhat on the size of the vessel, the flexible bag could be formed from several separately constructed sectors assembled to produce a circular containment consisting of several storage cells.

The storage vessel preferably includes an articulated segmented confinement and flotation frame 22 consisting of a plurality of equal length rigid segments 23 each having a plurality of flotation bodies 24 thereon, such as cylinders formed of synthetic cellular material of a well known type. The frame segments 23 are connected in end-to-end articulated relationship on two right angular axes by knuckles or swivels 25, one of which is shown in detail in FIG. 5.

Each frame segment 23 includes top and bottom plates 26 and 27 and reinforced end connector plates 28 disposed at right angles to the plates 26 and 27 and connected therewith by welding or any other connection technique specified by engineering demand.

The individual flotation bodies 24 are confined on the frame segments 23 between pairs of fixed plates 29, also attached in place between the plates 26 and 27. The float bodies have end internal plates, not shown, which receive removable bolts 30 whereby replacement of individual float bodies is rendered very easy when necessary.

Figures 2, 5, 6, 7, 8:
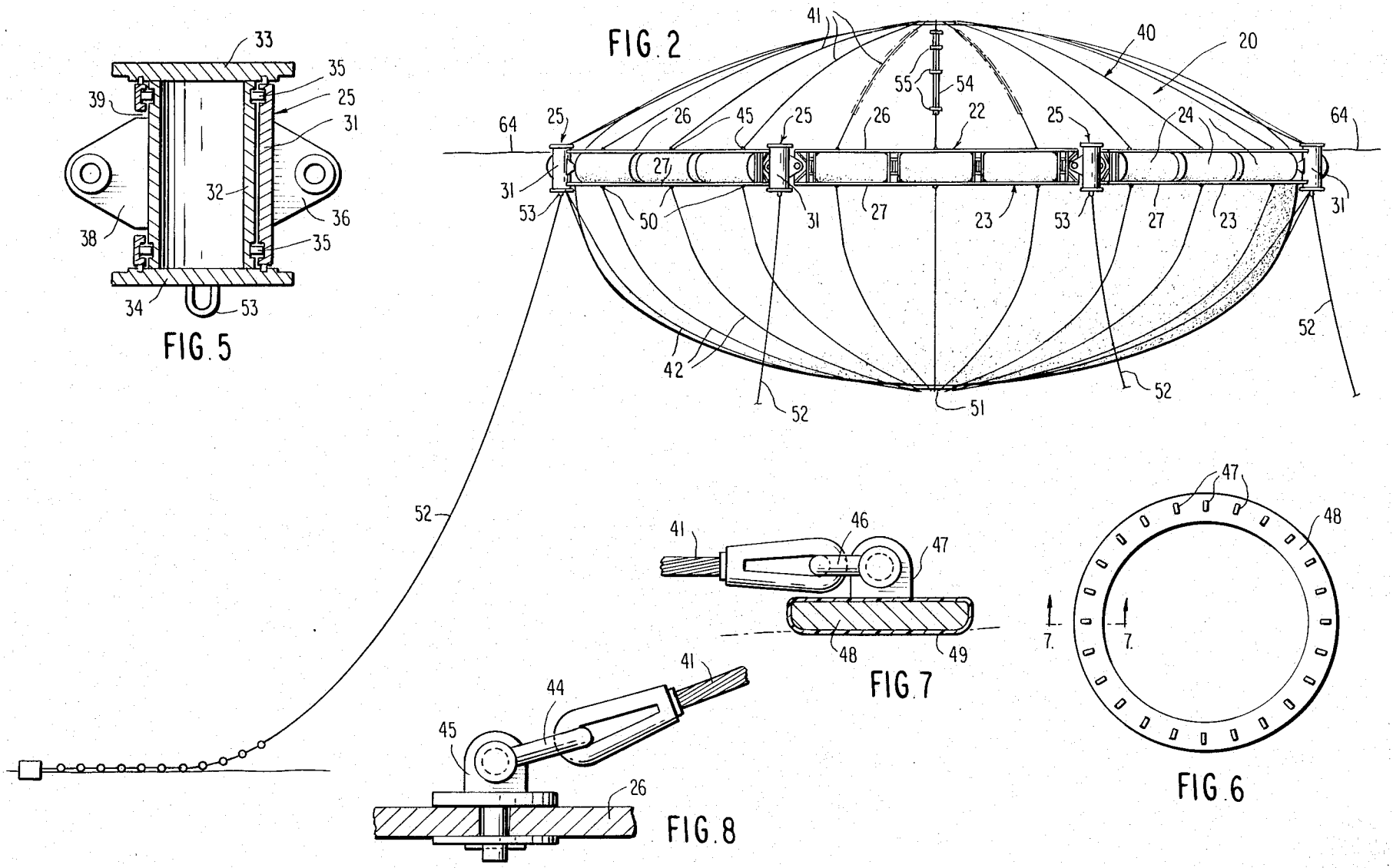
FIG. 2 is a side elevation of the storage vessel.
FIG. 5 is a central vertical section through a frame knuckle or swivel.
FIG. 6 is a plan view of a wire rope connector ring.
FIG. 7 is an enlarged fragmentary vertical section through the connector ring taken on line 7—7 of FIG. 6 and showing the connection of one wire rope with the ring.
FIG. 8 is a similar view showing the connection of one wire rope with a plate of the buoyant articulated frame.

Each knuckle 25 of the frame 22, FIG. 5, comprises an outer sleeve 31 which may rotate relative to a coaxial inner sleeve 32 having top and bottom end plates 33 and 34 fixed thereon. Intervening swivel bearings 35 between the two sleeves are provided.

The outer sleeve 31 carries rigid spaced lugs 36 which straddle one end connector plate 28 of a frame segment 23 and receive a suitable articulation pin 37. Similarly, each inner sleeve 32 carries a pair of fixed apertured lugs 38 welded thereto which straddle an adjacent end connector plate 28 and receive an articulation pin 37. Adjacent to the lugs 38, each outer sleeve 31 is slotted at 39 whereby the two sleeves 31 and 32 can rotate one relative to the other through an arc approximately $\pm 15°$ from the normal centered positions shown in the drawings. This arrangement provides controlled articulation of the bag confining flotation frame 22 in a horizontal plane. The slots 39 prevent excessive articulation of the frame segments 23 and thus prevent the frame from ever collapsing inwardly on the flexible containment bag 20 under the pressure of sea water in a storm. The frame segments can articulate freely on the axes of pins 37 at right angles to the axes of swivels 25 under the pressure of rough sea water. In this manner, the buoyant storage vessel can yield in all directions and assume varying shapes in local areas so as to render it compliant and responsive to sea forces without danger of rupturing.

A very important additional component of the buoyant storage vessel comprises a wire rope cage 40 consisting of a plurality of circumferentially equidistantly spaced upper wire ropes 41 and a like number of lower wire ropes 42. Preferably, these wire ropes or cables are coated as at 43, FIG. 10, with synthetic material to minimize abrasion. The lower ends of the upper wire ropes 41 are attached to clevises 44, FIG. 8, in turn pivotally attached to anchors 45 fixed to the top plates 26 of the buoyant frame segments. The top ends of the upper wire ropes 41, FIG. 7, are attached to clevises 46, in turn pivotally attached to anchors 47 on a top wire rope connector ring 48 preferably coated at 49 with synthetic material. The ring 48 is unattached to the containment bag 20 and is floatingly disposed thereon.

Similarly, the upper ends of lower wire ropes 42 are anchored at 50 to the bottom plates 27 of frame segments 23. The anchoring means 50 may be identical to the means shown in FIG. 8 for the top wire ropes 41. In like manner, the lower ends of wire ropes 42 are attached to a bottom floating wire rope connector ring 51 which may be identical to the top ring 48. The attachment structure at the lower ends of wire ropes 42 may be identical to the structure shown in FIG. 7 for the top wire ropes.

The storage vessel or cell 20 can be located at any desired position in a body of water and anchored in this position by suitable anchor lines 52 whose upper ends are attached to connecting elements 53 on bottom end plates 34.

As shown in FIGS. 9 and 10, the upper wire ropes 41 of cage 40 rest on reinforcing contact strips 54 of synthetic material attached to the exterior surface of the bag 20. Spaced loops 55 of similar material attached to the bag 20 extend across the wire ropes 41 and confine them to the areas spanned by strips 54. This prevents the upper wire ropes from whipping against the upper portion of bag 20 or slidably contacting the bag except through the strips 54.

The lower ropes 42 are unattached to the lower portion of the bag 20 below the flotation and confining frame 22. This enables the bottom of the bag to freely collapse upwardly during the process of emptying the storage vessel in response to buoyant pressure exerted by the water on the bottom of the bag. The unattached wire ropes 42 do not impede this upward collapsing and these ropes with the lower ring 51 will simply hang freely from the frame 22 as the bottom of the bag moves upwardly while the fluid content is discharged from the top of the bag.

To facilitate filling and emptying the storage vessel, a pump deck 56 is provided on one frame section 23 having suitable pumps 57 and control valves 58. Fluid delivery and discharge hoses 59 and 60 are connected with the valves 58 at their outer ends and are also connected with inlet and outlet fittings 61 and 62 of the bag 20 near the top center thereof. By this means, oil or the like can be pumped into the vessel or removed therefrom at required times. Buoyant sea pressure at the bottom of the bag 20, as previously mentioned, assists in the emptying of the vessel. An internal pressure relief device 63 is also provided on the top of the bag 20 as shown in FIG. 1, for allevation of vapor pressures.

In a fluid-filled condition as illustrated in FIG. 2, a larger portion of the vessel below the frame 22 will be submerged below the waterline 64 than above the waterline. This contributes to the stability of the floating storage vessel. The size of the vessel can be varied depending upon requirements. Great virtue of the device is its ability to be transported to a given location and assembled and anchored in a short period of time compared to conventional rigid equipment. The articulated frame 22 with the wire rope cage not only supports the bag 20 but protects it in rough seas and in cases of collision with floating objects. The storage vessel is very resistant to rupture which is a most essential feature.

In addition to forming a storage facility for oil offshore, the vessel can have utility in the cleaning up of large oil spills. The floating oil, after being confined by floating fences, can be pumped into the floating containment vessel or a plurality of such vessels. The vessel, therefore, is most versatile in terms of its uses and fills needs not satisfied in the prior art.

Figure 11:
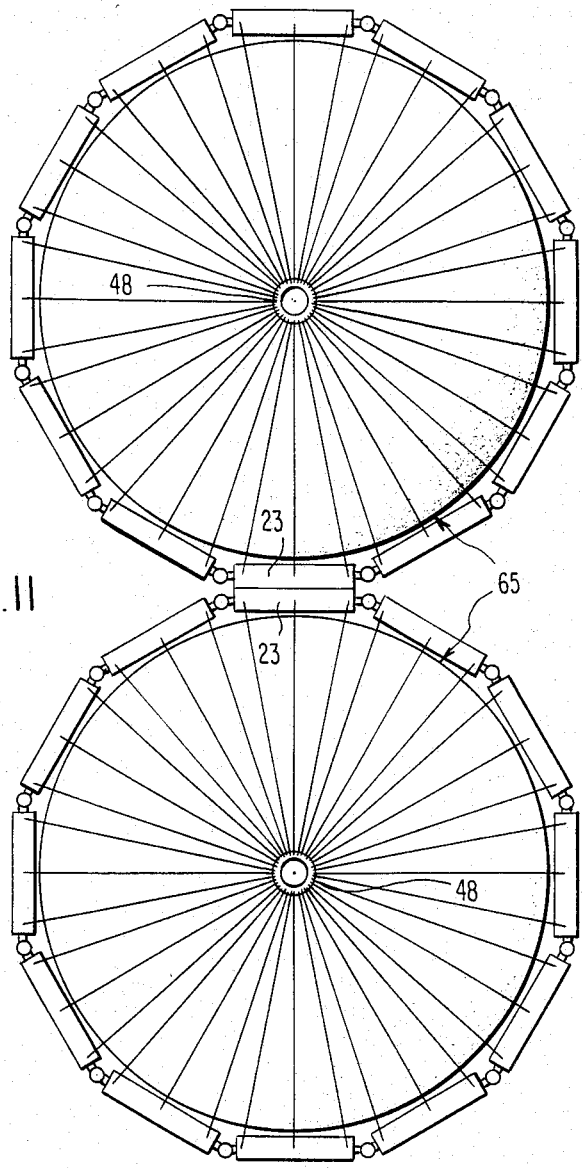
FIG. 11 is a partly schematic plan view showing a modified form of the invention.

As illustrated in FIG. 11, a cluster or colony of storage vessels 65 constructed in the manner described for the single vessel shown in FIGS. 1–10 can be created simply by joining two or more of the vessels 65 in any type of array and adjacent frame segments 23. In such a colony of vessels, the storage capacity can be immense and almost limitless. The individual vessels can yield and conform to the forces of the sea and the connected vessels of the cluster can yield or articulate one relative to the other.

Figure 12:
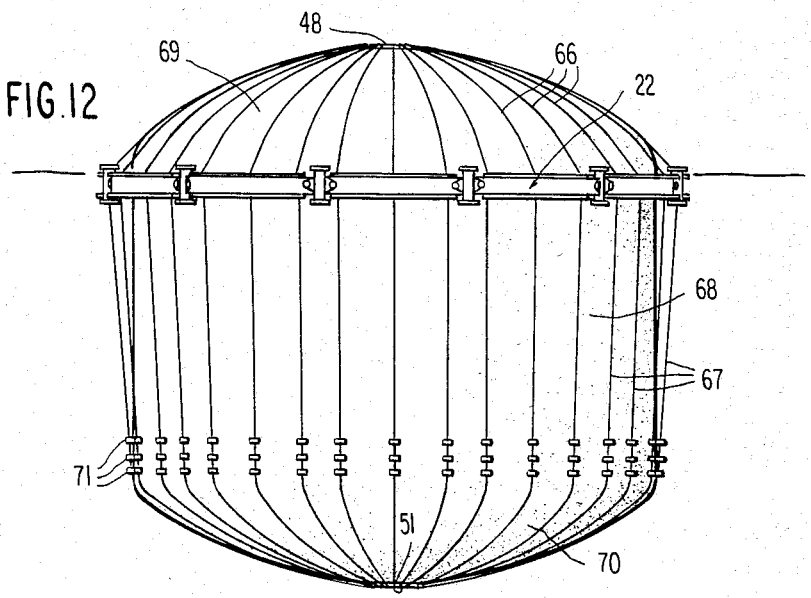
FIG. 12 is a side elevation showing a further modification.

FIG. 12 depicts a modified form of storage vessel having the protective confining flotation frame 22, as previously described, and having a wire rope cage including upper wire ropes 66 and lower ropes 67 with corresponding ends attached to frame 22 and to top and bottom rings 48 and 51 in the previously described manner.

The storage vessel in FIG. 12 is of greater capacity than the vessel shown in FIG. 2 because of its modified shape. The former vessel is double convex and disc-like, being comparatively shallow in the vertical direction, whereas the latter vessel is much deeper vertically and includes a substantially cylindrical portion 68 below an upper convex dome 69. The vessel also includes a convex bottom 70. When filled with fluid, such as oil, the dome 69 will normally be above the waterline with the remainder of the vessel submerged.

Due to the axial depth of the vessel brought about by the addition of the nearly cylindrical portion 68, it is necessary to provide preferably three spaced restraining loops 71 for the lower wire ropes 67 on the exterior of the flexible bag near and above the convex bottom 70. These loops are of the type described at 55 in FIG. 9. The upper wire ropes 66 are restrained in the same manner shown and described in the prior embodiment. The lower wire ropes 67 remain unrestrained adjacent to the convex bottom 70 of the vessel, as in the prior form of the invention.

The diverse advantages of the invention over the known prior art should now be apparent without the necessity for further description.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

We claim:

1. A marine storage vessel for fluids comprising a flexible containment body portion formed of tough and durable sheet material and having an inlet and outlet means for fluid near its top, and a segmented marginal flotation and confining frame for the containment body portion surrounding the latter, the segments of said frame being substantially rigid and including flotation components, and means joining the segments end-to-end in articulated relationship for articulation one relative to another on substantially vertical and horizontal axes, the articulation of the frame segments on the horizontal axis being substantially free, the articulation of the frame segments on the vertical axis being controlled, to thereby prevent the frame from collapsing inwardly on the flexible containment body portion under the pressure of sea water in a storm.

2. A marine storage vessel for fluids as defined in claim 1, and the containment body portion being circular and symmetrical around a center vertical axis, and said frame being polygonal and consisting of plural equal length segments each having substantial tangent contact with the periphery of the containment body portion.

3. A marine storage vessel for fluids as defined in claim 1, and a rope cage for the containment body portion including a multiplicity of spaced ropes which span the top and bottom portions of the containment body portion and have their top and bottom ends joined near the center of the containment body portion substantially a the top and bottom thereof, and marine anchorage means for said vessel connected with the rope cage at a plurality of spaced points around the perimeter of the vessel.

4. A marine storage vessel for fluids as defined in claim 3, and the containment body portion being circular and symmetrical around a center vertical axis and said ropes being circumferentially equidistantly spaced, and the top and bottom ends of the ropes being attached in circumferentially spaced relationship to top and bottom rope connector rings of comparatively small diameters which are unattached to and lie floatingly on the top and bottom of the containment body portion substantially at the axial center thereof.

5. A marine storage vessel for fluids as defined in claim 4, and restraining loops for said ropes adjacent to the upper portion only of the containment body portion to prevent appreciable circumferential displacement of the ropes, the ropes adjacent to the lower portion of the containment body portion being freely disposed on the body portion and unrestrained.

6. A marine storage vessel for fluids as defined in claim 5, and reinforcing strips of abrasion-resisting material on the upper part of the containment body portion adjacent to and underlying said ropes.

7. A marine storage vessel for fluids as defined in claim 6, and said ropes comprising wire ropes covered with abrasion-resisting synthetic material similar to the material from which said strips are formed.

8. A marine storage vessel for fluids as defined in claim 4, and the containment body portion being disc-like and having convex top and bottom portions and being shallower along its vertical axis in comparison to its diameter.

9. A marine storage vessel for fluids as defined in claim 4, and the containment body portion including an intermediate substantially cylindrical vertical axis section and top and bottom convex sections.

10. A marine storage vessel for fluids comprising a flexible containment body portion formed of tough and durable sheet material and having an inlet and outlet means for fluid, a segmented marginal flotation and confining frame for the containment body portion completely surrounding the latter, the segments of said frame being substantially rigid and comprising top and bottom structural plates and float bodies joined between said plates, and the end portions of said plates being joined end-to-end by articulation devices which enable all segments of the frame to articulate one relative to another on two substantially right angular axes, each articulation device comprising a pair of coaxial outer and inner sleeves which can have relative rotation on a substantially vertical axis, frame segment connector elements on the outer and inner sleeves and being pivotally connected with said plate end portions through substantially horizontal axis pivot elements, each outer sleeve being circumferentially slotted adjacent to the connector element of the inner sleeve and receiving such connector element therethrough radially, whereby articulation between adjacent sections of said frame on a substantially vertical axis is positively limited within a range of approximately $\pm 15°$ from a centered position within the slot of the outer sleeve, and a cage means confining the containment body portion above and below said frame.

11. A marine storage vessel for fluids as defined in claim 10, and said cage comprising a cage formed of multiple spaced flexible restraining elements having corresponding ends joined together at the top and bottom center of the containment body portion and having other corresponding ends attached to said frame.

12. A marine storage vessel for fluids as defined in claim 10, wherein the containment body portion is circular and said frame is polygonal and being comprised of a plurality of equal length segments each being approximately tangent to the periphery of the containment body portion.

13. A marine storage vessel for fluids as defined in claim 10, and circumferentially spaced anchor lines for the vessel having their upper ends attached to the articulation devices.

14. A marine storage vessel for fluids as defined in claim 10, and a cluster of said storage vessels connected one to another in the cluster along one pair of frame segments of adjacent storage vessels.

15. A marine storage vessel for fluids as defined in claim 10, and a service platform atop one segment of the frame and mounting fluid pumping and control valve means connected with said inlet and outlet means.

* * * * *